US010201229B2

(12) United States Patent
Lambracht

(10) Patent No.: US 10,201,229 B2
(45) Date of Patent: Feb. 12, 2019

(54) PATIO TABLE THAT CONVERTS INTO A CLOTHESLINE

(71) Applicant: Rudolf Lambracht, New Milford, CA (US)

(72) Inventor: Rudolf Lambracht, New Milford, CA (US)

( * ) Notice: Subject to any disclaimer, the term of this patent is extended or adjusted under 35 U.S.C. 154(b) by 0 days.

(21) Appl. No.: 15/603,707

(22) Filed: May 24, 2017

(65) Prior Publication Data

US 2018/0338613 A1 Nov. 29, 2018

(51) Int. Cl.

| | |
|---|---|
| ***A47B 85/06*** | (2006.01) |
| ***D06F 53/02*** | (2006.01) |
| ***A47B 1/04*** | (2006.01) |
| ***A47B 37/04*** | (2006.01) |

(52) U.S. Cl.

CPC ..... *A47B 85/06* (2013.01); *A47B 1/04* (2013.01); *A47B 37/04* (2013.01); *D06F 53/02* (2013.01)

(58) Field of Classification Search

CPC ..... A47B 85/06; A47B 1/04; A47B 37/04; A47B 53/02

USPC ..... 211/119.01; 108/28, 29, 31, 50.11, 14, 108/16

See application file for complete search history.

(56) References Cited

U.S. PATENT DOCUMENTS

| | | | | |
|---|---|---|---|---|
| 91,921 A * | 6/1869 | Devol | | |
| 147,470 A * | 2/1874 | Berner | | |
| 158,844 A * | 1/1875 | Iske | | |
| 572,391 A * | 12/1896 | Whitford | | |
| 846,319 A * | 3/1907 | Knapp | | |
| 1,279,665 A * | 9/1918 | David et al. | 108/31 | |
| 1,324,709 A * | 12/1919 | Wintermute | A47B 1/04 | 108/69 |
| 2,084,854 A * | 6/1937 | McCarthy | D06F 59/02 | 108/119 |
| 2,473,047 A * | 6/1949 | Bershad | D06F 57/12 | 126/9 R |
| 2,486,035 A * | 10/1949 | Koester | D06F 57/125 | 211/118 |
| D162,149 S * | 2/1951 | Gaither | D32/58 | |
| 2,594,158 A * | 4/1952 | Hannameyer | A47B 37/00 | 108/25 |
| 2,641,072 A * | 6/1953 | Maher | D06F 81/006 | 108/31 |
| 5,235,919 A * | 8/1993 | Robuck | A01M 29/06 | 108/50.11 |
| 9,096,968 B1 * | 8/2015 | Munoz | D06F 53/04 | |
| 2013/0062296 A1 * | 3/2013 | Roberts | D06F 53/04 | 211/119.01 |

FOREIGN PATENT DOCUMENTS

| | | | |
|---|---|---|---|
| EP | 987361 | * | 3/2000 |
| WO | 2005088002 | * | 9/2005 |

OTHER PUBLICATIONS

CN 206157414 Figure and abstract (Year: 2017).*

* cited by examiner

*Primary Examiner* — Janet M Wilkens

(57) ABSTRACT

The patio table that converts into a clothesline is easily transformed from a patio table into a functional clothesline. The arms, crossbars and clotheslines easily fold out and retract back into the patio table. The patio table may be made out of different materials such as pvc, aluminum, wood or steel. It may be manufactured in different sizes.

1 Claim, 6 Drawing Sheets

PATIO TABLE THAT CONVERTS INTO A CLOTHESLINE

BACKGROUND

The use of clotheslines has been well known for many years. Most clotheslines are visible and in many locations especially housing developments they are not permitted due to local regulations.

My invention has been developed because I am very concerned about our environment (greenhouse effect, climate change, etc). I am also interested in saving fossil fuels and limiting their association with global warming. For the above reasons people may again prefer clotheslines. It is much better to use the sun and air to dry clothes than electric and gas dryers, it also saves money, non-renewable resources and is good exercise.

Like mentioned before some people are not allowed to use a clothesline and my invention will be a more acceptable item. My table that converts into a clothesline may circumvent the limitations encountered. My table top is made out of high density plastic but may also be made out of other materials like steel, wood and aluminum. This table looks like a normal table but opens up and converts into a clothesline. I feel my invention may be able to be used where clotheslines are prohibited and can be very useful for people living in small spaces and dense communities.

My invention can be enclosed in a party tent with a canvas roof and optional screened side walls to keep people and clothes dry when it rains and prevent sunburn on midsummer days. Clothes will be hidden from neighbors view. The screen will keep bugs and birds out as well. I am not making claim for canvas tent because it already exists.

SUMMARY

My invention is superior to whatever is on the market today. My invention can be a dining room table, picnic table or patio table that will easily convert into a clothesline.

It is another object of the present invention to provide a socially acceptable clothesline.

DETAILED DESCRIPTION OF THE SPECIFICATION

Figure 1:
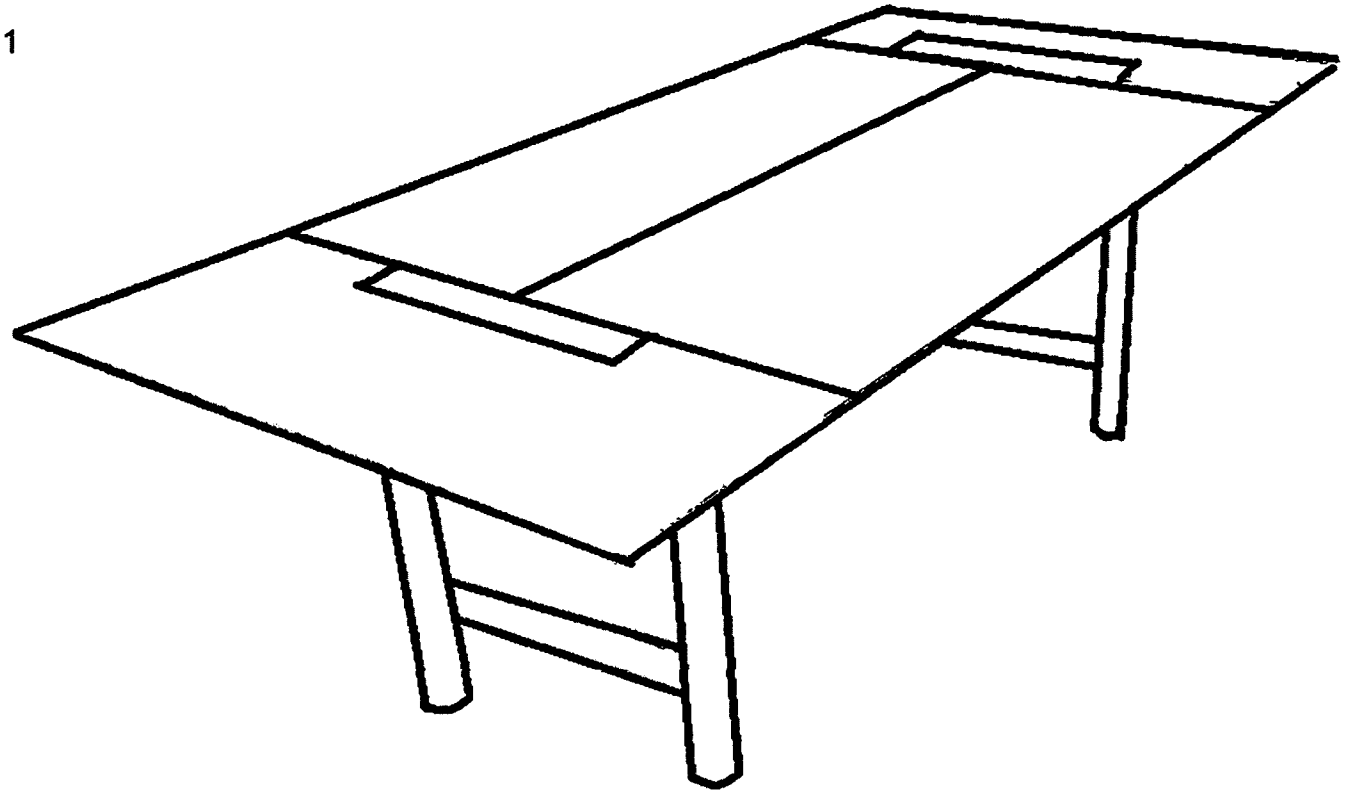
FIG. 1 is a perspective view of the patio table closed
Figure 2:
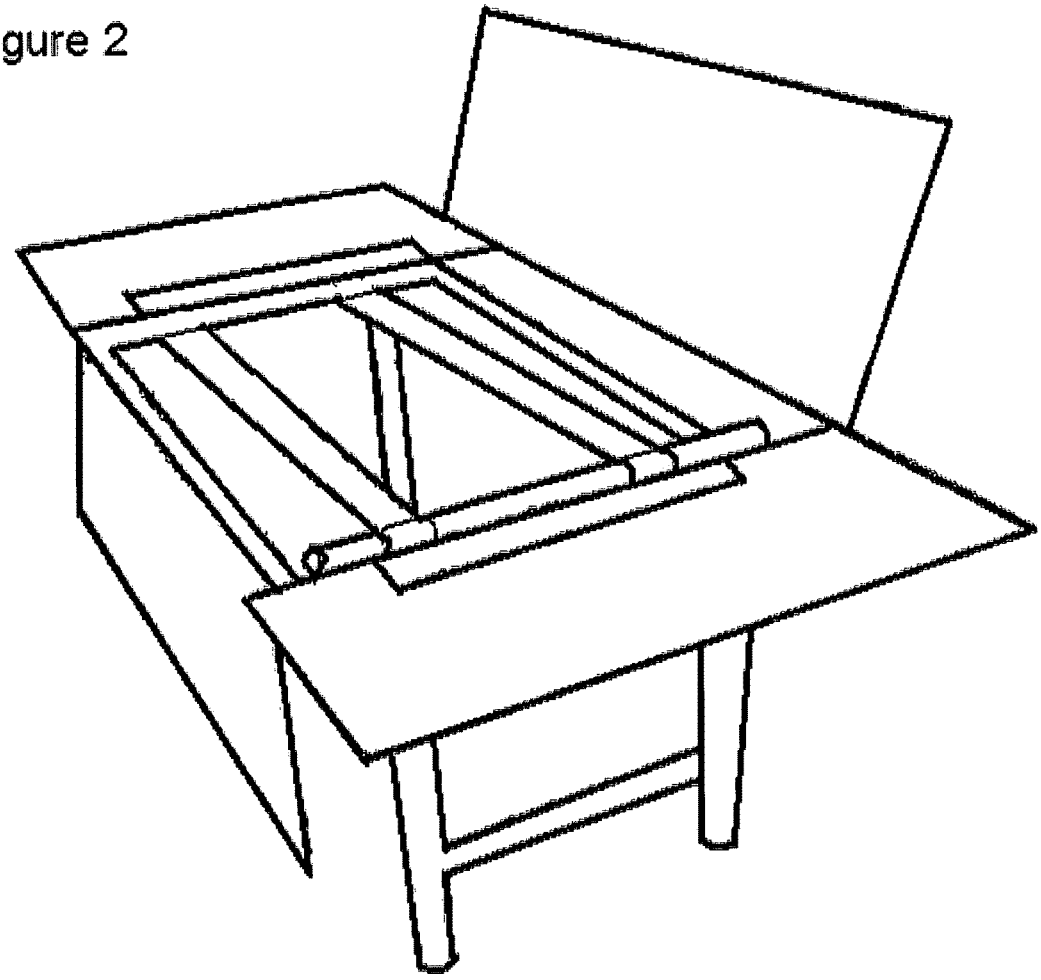
FIG. 2 is a view of the table opened up and arms inside
Figure 3:
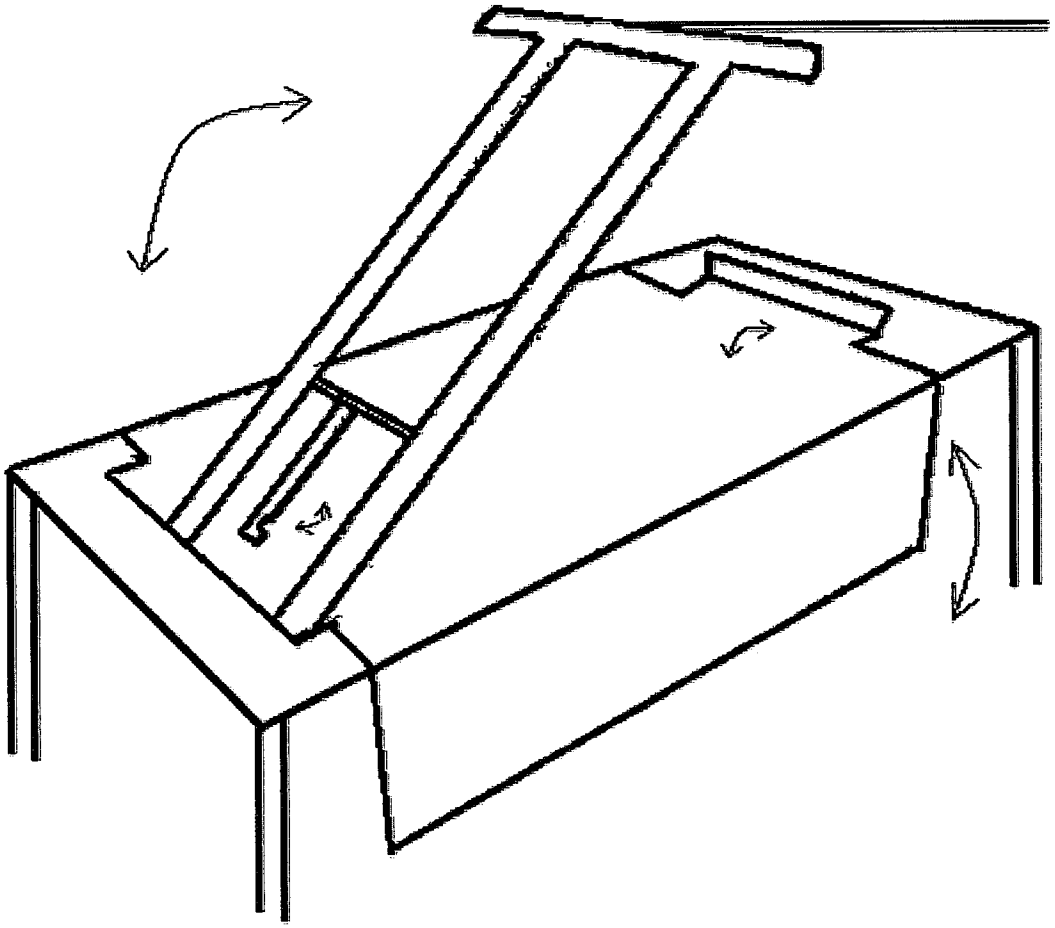
FIG. 3 is a view with partially folded out arm
Figure 4:
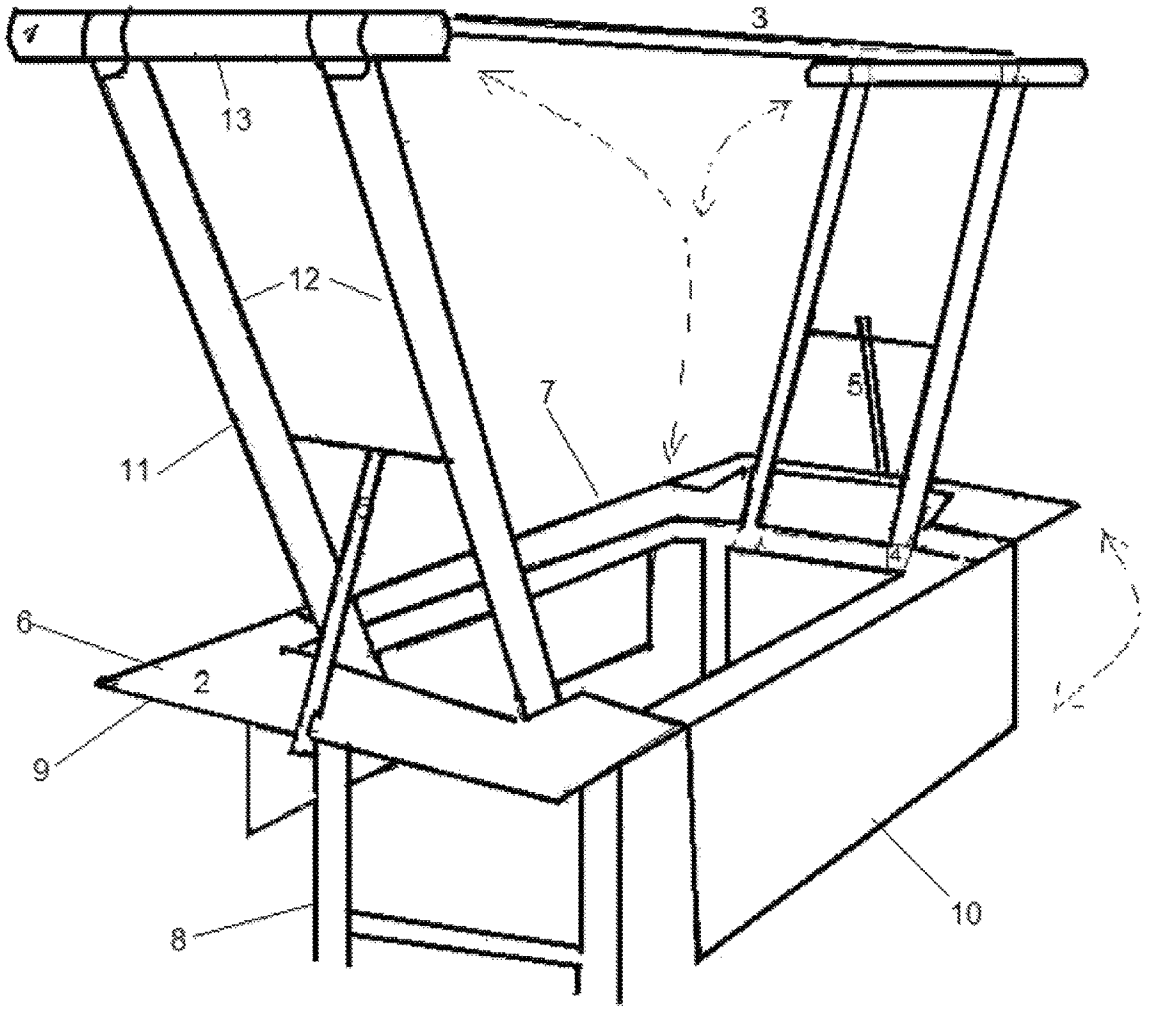
FIG. 4 is a view of fully open and ready to be used clothesline
Figure 5:
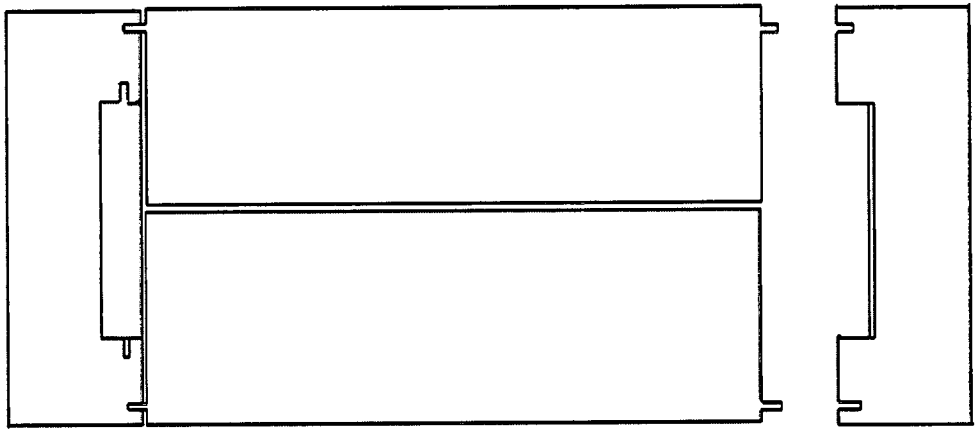
FIG. 5 is a view showing the pin hinge detail
Figure 6:
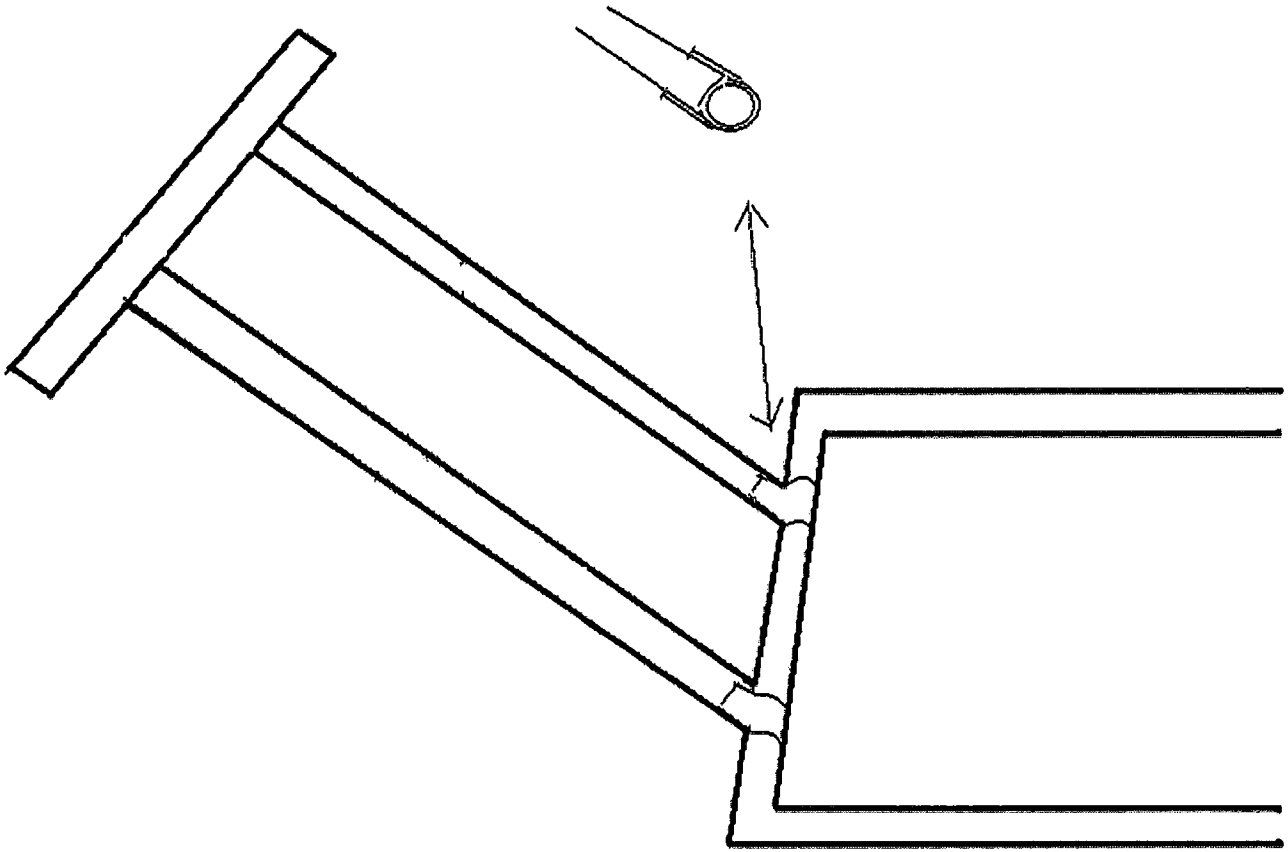
FIG. 6 is a view showing the strap hinge detail

FIGS. 1 and 2 teach a patio table (6) that opens up to convert into a clothesline and closes up to be used as a table. The table has a table base (7) with legs (8). There is a table top (2) with two attached end panels (9) shown in FIG. 5 and two hinged side panels (10) opening out from over the table base to a clothesline configuration of the table in FIG. 4 and overlapping the table base in a table configuration in FIG. 1. The table top can be made of high density plastic or wood. There is a clothesline (1) supported within the table base comprising two supports (11), each comprised of a pair of arms (12) pivotally attached at lower ends to the table base between raised and lowered positions as shown in FIG. 6 and including a crossbar (13) at top ends thereof. The supports can be made of pvc, steel or aluminum. Seven clotheslines (3) attached to and spread out between the crossbars and are positioned over the table base when in the clothesline configuration. The clotheslines can have a length of 8 feet. Positioning braces (5) are attachable between a respective raised position arm and attached end panel when the table is in the clothesline configuration.

What is claimed is:

1. A patio table that opens up to convert into a clothesline and closes up to be used as a table, the table comprising:

A table base with legs;

A table top with two attached end panels and two hinged side panels, the side panels opening out from over the table base to a clothesline configuration of the table and overlapping the table base in a table configuration;

A clothesline supported within the table base comprising two supports, each comprised of a pair of arms pivotally attached at lower ends to the table base between raised and lowered positions and including a crossbar at top ends thereof, seven clotheslines attached to and spread out between the crossbars and positioned over the table base when in the clothesline configuration; and Two positioning braces, each attachable between a respective raised position arm and attached end panel when the table is in the clothesline configuration.

* * * * *